US006880453B2

(12) United States Patent
Weixler

(10) Patent No.: US 6,880,453 B2
(45) Date of Patent: Apr. 19, 2005

(54) DISPLACEMENT DEVICE

(75) Inventor: Leonhard Weixler, Thierhaupten (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 21 days.

(21) Appl. No.: 10/665,488

(22) Filed: Sep. 22, 2003

(65) Prior Publication Data

US 2004/0055459 A1 Mar. 25, 2004

(30) Foreign Application Priority Data

Sep. 20, 2002 (DE) ..... 102 43 744

(51) Int. Cl.[7] ..... F15B 15/14
(52) U.S. Cl. ..... 92/161; 175/220
(58) Field of Search ..... 92/161; 175/122, 175/203, 220; 166/77.4

(56) References Cited

U.S. PATENT DOCUMENTS 5,333,839 A * 8/1994 Lonardi et al. ..... 266/45
5,690,184 A * 11/1997 Tsuchiya ..... 175/220
5,988,298 A * 11/1999 Cheng et al. ..... 173/147
6,604,586 B1 * 8/2003 Tremblay ..... 175/203

FOREIGN PATENT DOCUMENTS

| | | | |
|---|---|---|---|
| DE | 7146219 | 12/1971 | ..... F15T/15/17 |
| DE | 198 13 902 C1 | 6/1999 | ..... E21B/17/07 |
| DE | 93 21 598 U1 | 5/2000 | ..... B65F/3/28 |

* cited by examiner

*Primary Examiner*—Thomas E. Lazo
(74) *Attorney, Agent, or Firm*—Jacobson Holman PLLC

(57) ABSTRACT

The invention relates to a displacement device, particularly for construction machines, having a guide, a carriage, which is displaceably mounted along the guide, and an operating cylinder for displacing the carriage. According to the invention, for increasing the buckling resistance, at least one support element is provided, being displaceably mounted both on the piston rod and on the guide or the carriage and that for preventing lateral buckling of the piston rod, on extending the said piston rod the support element is displaceable up to a predetermined support position on said piston rod.

10 Claims, 2 Drawing Sheets

DISPLACEMENT DEVICE

Figure 1:
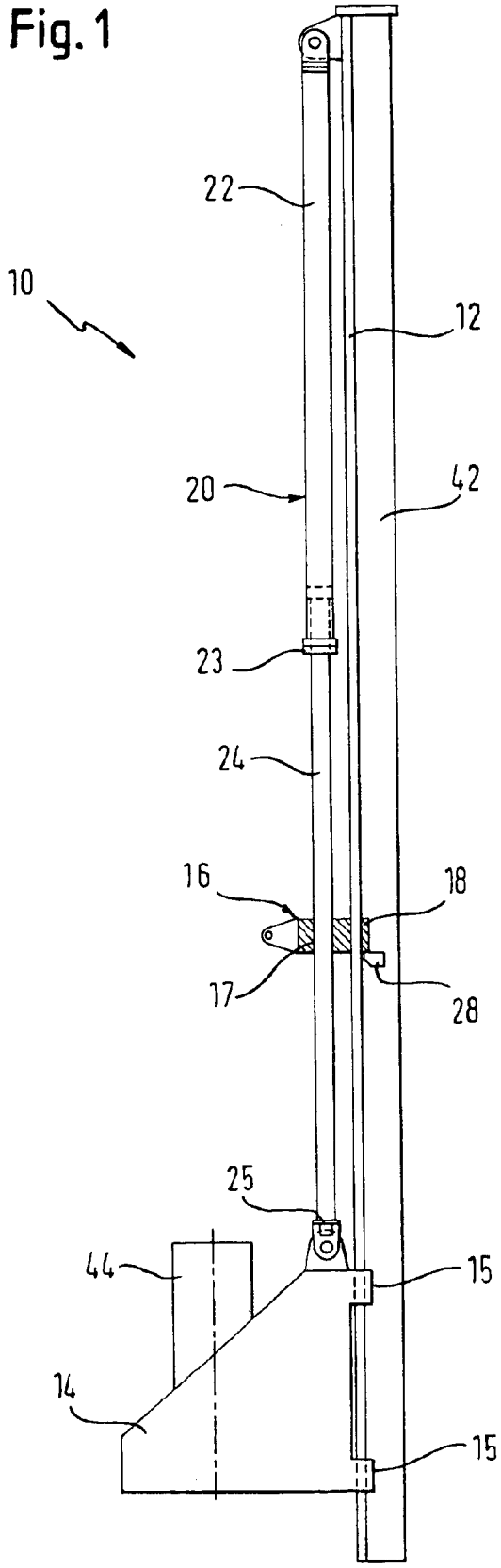

The invention relates to a displacement device, particularly for construction machines, having a guide, a carriage, which is displaceably mounted on the guide, an operating cylinder for displacing the carriage, said operating cylinder having a piston rod extendible from a cylinder block, and a support element for preventing buckling of the piston rod.

Displacement devices are e.g. used on construction engineering machines, in which a drilling or boring implement or a vibrator is moved vertically along a vertical mast or pole through the operating cylinder. Such a construction machine is e.g. described in DE 198 13 902 C1. Thus, by means of the operating cylinder, on sinking the drilling implement or vibrator a desired compressive force can be exerted, which ensures the necessary work advance. Particularly for this application it is necessary to have operating cylinders with a considerable stroke length of up to 5 m and more. This requires correspondingly long piston rods for the operating cylinder.

As a result of the considerable piston rod length and the high force action on the piston rod, with such displacement devices there is a risk of lateral buckling of the piston rod.

In order to prevent with the necessary certainty a lateral buckling of the piston rod, it is known to construct the piston rod with a correspondingly large cross-section. This means a correspondingly high weight and corresponding high costs for the operating cylinder.

DE 71 46 219 U discloses a carriage guide, which is intended to prevent sagging of a horizontally positioned telescopic cylinder. For this purpose a support bearing is non-positively fixed to a telescopic cylinder tube.

DE 93 21 598 U1 discloses a piston-cylinder unit with a cylinder and a piston rod for moving a plate in a container. Both the cylinder and the piston rod have a bearing point, which can in each case be locked on a detent rail. By the alternate locking of the two bearing points and a simultaneous reciprocating movement of the piston rod in the cylinder, it is possible to achieve a joint movement of the piston-cylinder unit along the detent rail.

The object of the invention is to provide a displacement device, where the risk of a lateral buckling of a piston rod is reliably prevented in a simple manner.

The displacement device according to the invention is characterized in that the support element is displaceably mounted both on the piston rod and also on the guide or carriage and that the support element is displaceable on the piston rod on extending said piston rod up to a predetermined support position.

A fundamental idea of the invention is to provide on the piston rod a displaceable support element, which couples the piston rod to the guide or carriage at a particularly critical position. This increases the rigidity and therefore the lateral buckling resistance at the support position. Compared with the known displacement devices, as a result of the inventive arrangement of the support element and in the case of an identical or increased buckling resistance it is possible to use a smaller diameter piston rod and therefore a less expensive operating cylinder.

It is fundamentally possible to use for the displacement devices according to the invention any type of operating cylinders, e.g. a pneumatic cylinder. However, according to the invention, it is particularly advantageous for the operating cylinder to be a hydraulic cylinder. Thus, hydraulic cylinders are used for applying high forces, which can lead to a corresponding risk of the lateral buckling of the piston rod.

A preferred embodiment of the displacement device according to the invention involves the operating cylinder being articulated on the one hand to the guide and on the other to the carriage and being positioned parallel to the guide. With this arrangement a good force transfer through the operating cylinder to the carriage is obtained and simultaneously there is a good displaceability of the support element on the piston rod and the guide or carriage. Preferably the support element has sliding sleeves or shoes with which the support element is displaceably mounted along the piston rod or guide.

In principle, the support element could be displaceable with the piston rod by means of an easy clamp fit thereon. According to the invention, a particularly low-wear construction of the displacement device is brought about in that there is a dog on the carriage for displacing the support element. The dog is fitted to the carriage in such a way that when the carriage reaches the end position, the slidingly mounted support element is guided by the dog up to the desired support position. On retracting the piston rod, the support element can be returned in simple manner through the head of the piston rod and together with the carriage into the retracted starting position.

It is also advantageous according to the invention that for limiting the displacement of the support element a stop member is provided on the guide. This is particularly appropriate if the support element is moved by static friction on the piston rod or by the effect of gravity, e.g. if the piston rod is extended vertically downwards. A stop member ensures a clearly defined positioning of the support element in the desired support position.

According to the invention, for a particularly good stiffening of the piston rod, the support element completely embraces the piston rod. It is e.g. possible to use for this purpose a sliding sleeve, which is drawn onto the piston rod. The sliding sleeve is then fixed in a corresponding bearing opening of the support element.

In the case of a single support element, it is appropriate that in the case of a completely extended piston rod, the support position is located in the centre of the extended piston rod. Whilst taking account of the corresponding Euler's buckling case, this represents the critical position for the buckling risk. In this central position the support element produces the maximum action against lateral buckling.

According to the invention, in the case of particularly great stroke lengths, several support elements are provided on a piston rod and their support positions are in each case mutually offset. This can be brought about by a cascade-like arrangement of the support elements with correspondingly provided step-like dogs or stops. This makes it possible to reliably stiffen and support a very long piston rod of above 10 m.

Fundamentally, the displacement device according to the invention can be used in the most varied sectors. The invention can also be used with smaller stroke lengths and it is mainly a question of the relationship between the maximum displacement force of the piston rod length, the piston rod diameter and the necessary buckling resistance. As the purchase price of operating cylinders rises significantly with increasing size, the use of the inventive displacement device is particularly economic as from stroke lengths of 1 m or more.

High economic advantages are achieved according to the invention in the case of a construction machine, in which the guide is constructed on a mast which is vertical in operation and the piston rod is downwardly extendible along the mast. The displacement device is more particularly used for rotary drilling implements for placing foundation piles in the ground. The support element can be slidingly mounted and is moved into the support position by gravity.

A further advantageous use is provided in the case of a construction machine in which the guide is constructed as an inside guide and the carriage as an outside guide and the piston rod is vertically upwardly extendible in operation. These so-called guide means are used for vibrators for sinking piles into looser soil.

The invention is described in greater detail hereinafter relative to preferred embodiments and the attached diagrammatic drawings, wherein show:

FIG. 1A diagrammatic side view of a displacement device for a drilling implement in accordance with the invention.

FIG. 2A diagrammatic side view of a displacement device according to the invention for a guide.

According to FIG. 1 a displacement device 10 according to the invention is shown in a partly represented drilling implement for sinking bores for foundation piles. A guide 12 constructed as a rail is located on a vertical mast 42, which is normally connected to a superstructure of a construction vehicle. Along the guide 12 is vertically displaceably mounted a carriage 14 by means of two embracing sliding devices 15. On the carriage 14 is placed a rotary drive 44 with which in known manner a drilling or boring tool, such as a soil auger can be driven in rotary manner.

For the downward displacement of the carriage 14 with a predetermined compressive force an operating cylinder 20 is provided, whose cylinder block 22 is articulated to the mast top, whereas the piston rod 24 extendibly mounted in the cylinder block 22 is articulated to the carriage 14 by its head 25.

On the cylindrical piston rod 24 is displaceably mounted a cross-sectionally represented, plate-like support element 16 by means of a guide shoe. The support element 16 extends transversely to the piston rod 24 up to the guide 12, on which the support element 16 is also slidingly displaceably mounted by means of a guide shoe 18. On inserting the piston rod 24 into the cylinder block 22, the support element 16 remains in the position shown in FIG. 1 until a stop face on the head 25 of piston rod 24 engages with the support element 16 and carries the same and raises it during the further insertion of the piston rod 24. In the inserted position of the piston rod 24, the support element 16 on the one hand engages on a stop flange 23 of the cylinder block 22 and on the other on the head 25 of piston rod 24.

On extending the piston rod 24 with the articulated carriage 14, the support element 16 follows the extending movement as a result of its gravity until the support element 16 comes to rest in a predetermined support position on a stop 28 on guide 12. The support element 16 remains in this support position until the piston rod 24 with the support element 14 has reached the completely extended position shown in FIG. 1. With this maximum stroke length, in principle there is the greatest risk of lateral buckling in the centre of piston rod 24 and as a result of the positioning of the support elements 16 at this critical point, an increased security is ensured.

Figure 2:
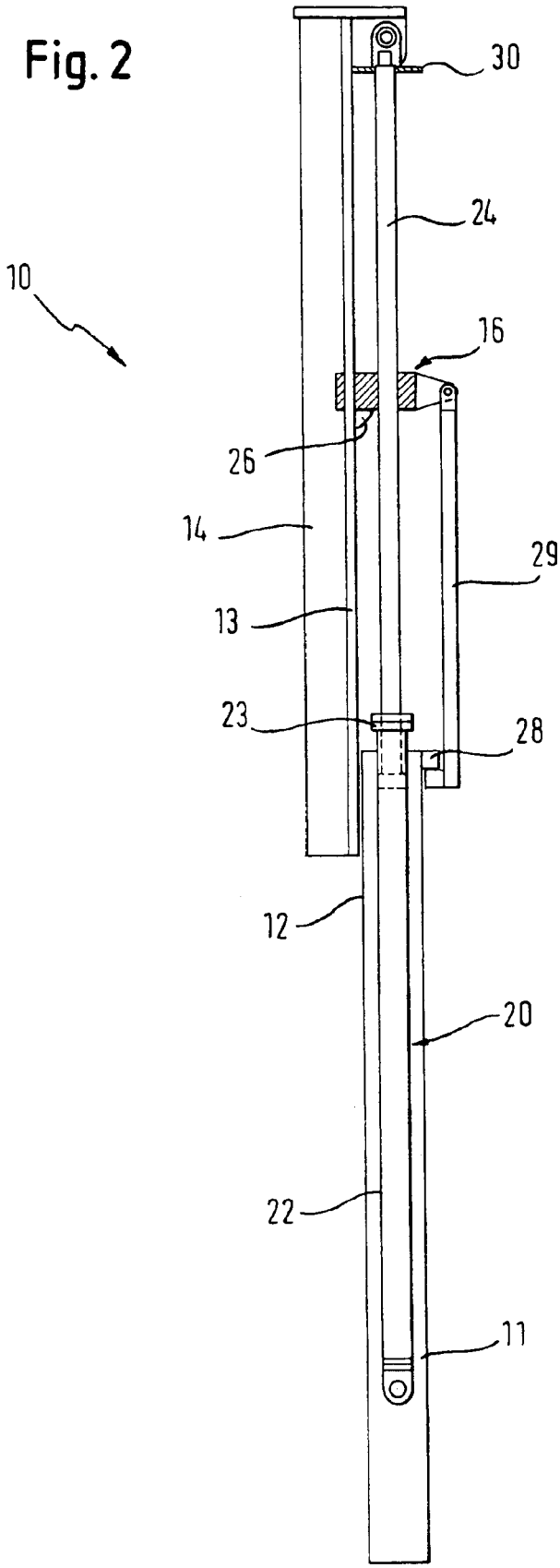

Another displacement device 10 according to the invention is explained in conjunction with the guide device shown in FIG. 2. In an outer guide 11, which is vertical in operation, is placed a guide 12 along which there is vertically displaceable a carriage 14 forming the inner guide. In the case of this guide device, the elongated carriage 14 has a guide rail 13, which in conjunction with the guide 12 ensures a clearly defined linear movement. To the outer guide 11 is fitted a cylinder block 22 of an operating cylinder 20 extending parallel to guide 12 and guide rail 13, the piston rod 24 mounted in the cylinder block 22 being connected at its upper end to the head of carriage 14. A support element 16 is slidingly displaceably mounted both along the piston rod 24 and along the guide rail 13 of carriage 14.

In a retracted position of the piston rod 24 the underside of the support element 16 rests on a stop flange 23 of the cylinder block 22, whereas the top of the support element 16 is contacted by a stop plate 30 at the head of piston rod 24.

On extending the piston rod 24, the support element 16 initially remains in its position on the stop flange 23 until the carriage 14 moved upwards by the piston rod 24 contacts by means of a dog 26 the underside of the support element 16 and now moves the same upwards with it. The dog 26 is located on the carriage 14 in such a way that in the maximum extended position of the piston rod 24 the support element 16 is positioned roughly centrally. In this embodiment the definition of the support position is further aided by the fact that a further upward movement of the support element 16 is prevented by a downwardly directed, elongated counter-stop 29, which on reaching the support position acts against a stop 28 on the outer guide.

What is claimed is:

1. Displacement device, particularly for construction machines, with a guide, a carriage, which is displaceably mounted on the guide, an operating cylinder for displacing the carriage, the operating cylinder having a piston rod extendible from a cylinder block and a support element for preventing buckling of the piston rod, wherein the support element is displaceably mounted both on the piston rod and on the guide or carriage and the support element, on extending the piston rod, is displaceable up to a predetermined support position on said piston rod.

2. Displacement device according to claim 1, wherein the operating cylinder is a hydraulic cylinder.

3. Displacement device according to claim 1, wherein the operating cylinder is articulated on the one hand to the guide and on the other to the carriage and is positioned parallel to the guide.

4. Displacement device according to claim 1, wherein a dog is provided on carriage for the displacement of the support element.

5. Displacement device according to claim 1, wherein a stop is provided on guide for limiting the displacement of the support element.

6. Displacement device according to claim 1, wherein in the case of a completely extended piston rod, the support element is located in the centre of the extended piston rod.

7. Displacement device according to claim 1, wherein the support element completely embraces the piston rod.

8. Displacement device according to claim 1, wherein several support elements are provided on a piston rod, whose support positions are mutually offset.

9. Construction machine with a displacement device according to claim 1, wherein the guide is constructed on a mast which is vertical in operation and the piston rod is downwardly extendible along the mast.

10. Construction machine with a displacement device according to claim 1, wherein the guide is constructed as an inside guide and the carriage as an outside guide and the piston rod is extendible vertically upwards in operation.

* * * * *